US005481890A

United States Patent [19]

Millman

[11] Patent Number: 5,481,890

[45] Date of Patent: Jan. 9, 1996

[54] CYLINDRICAL LOCKSET KNOB TO LEVER CONVERSION ASSEMBLY

[76] Inventor: Norman A. Millman, 536 Cardinal Dr., Dresher, Pa. 19025

[21] Appl. No.: 29,545

[22] Filed: Mar. 11, 1993

[51] Int. Cl.[6] ..... E05B 13/10

[52] U.S. Cl. ..... 70/224; 70/451; 70/452; 292/347; 292/357; 292/236.3

[58] Field of Search ..... 70/224, 207–210, 70/215–217, 451, 452, 462, 466; 292/336.3, 347, 348, 356, 357

[56] References Cited

U.S. PATENT DOCUMENTS

| | | | |
|---|---|---|---|
| 2,947,561 | 8/1960 | Holden | 292/347 |
| 4,236,396 | 12/1980 | Surko et al. | 70/452 X |
| 4,502,719 | 3/1985 | Perry | 292/347 |
| 4,569,547 | 2/1986 | Fayerman et al. | 292/347 |
| 4,604,879 | 8/1986 | Nary et al. | 70/224 |
| 4,784,418 | 11/1988 | Pearson et al. | 292/357 X |
| 4,876,783 | 10/1989 | Campion et al. | 70/224 X |
| 4,921,289 | 5/1990 | Shen | 292/357 X |
| 5,177,987 | 1/1993 | Shen | 70/224 |
| 5,265,924 | 11/1993 | Kim | 292/347 X |
| 5,286,074 | 2/1994 | Lin | 292/357 X |

FOREIGN PATENT DOCUMENTS

| | | | |
|---|---|---|---|
| 1015000 | 8/1979 | Canada | 292/347 |
| 213849 | 3/1987 | European Pat. Off. | 292/356 |
| 2624180 | 6/1989 | France | 292/336.3 |
| 757842 | 9/1956 | United Kingdom | 292/336.3 |
| 2049017 | 12/1980 | United Kingdom | 292/336.3 |

*Primary Examiner*—Peter M. Cuomo
*Assistant Examiner*—Suzanne L. Dino
*Attorney, Agent, or Firm*—Paul Maleson

[57] ABSTRACT

A field conversion means to convert a knob-handle cylindrical lockset either with or without a key cylinder, installed in a door, to a lever-handle cylindrical lockset without changing any existing original key cylinder. The conversion means comprises an inside and an outside means, each including a lever-handle, a drive cartridge adaptor cylinder and a rosette or escutcheon containing a helical spring and a positive stop disk. The spring is biased to oppose droop of said lever-handle from a normal horizontal position and to oppose downward operating force, applied to said lever-handle and is increasingly biased when the lever is operated to oppose downward rotation of the lever. Stop means are provided in the rosette or escutcheon to limit the angular rotational travel of said lever-handle. Differently sized adapters are provided to permit the conversion of different sized cylindrical locks. The conversion means is applicable to all grades of cylindrical locksets for all functions, including those with key cylinders and interchangeable core cylinders, and all types of high security cylinder constructions. It can also be used with a knob rose assembly.

17 Claims, 9 Drawing Sheets

CYLINDRICAL LOCKSET KNOB TO LEVER CONVERSION ASSEMBLY

BACKGROUND OF THE INVENTION

The present invention relates to a cylindrical lock. More particularly it relates to an assembly which comprises a conversion kit for converting a knob operated cylindrical lockset to a lever lockset.

A very common lock used in the American market and in other markets is a fully cylindrical lockset which may have a five or six pin-tumbler cylinder in a standard configuration and/or a removable core cylinder. Such locksets come in ANSI series 1, which is a heavy-duty lock; and ANSI series 2 which is a standard duty and is the major commercial door lockset sold in the United States; and an ANSI series 3 which is a light commercial-duty lockset. These are all fully cylindrical locksets that were originally designed and patented by the Schlage Lock Company, many years ago.

There is a current and a future increasing demand and requirement for the provision of lever-operated locksets in situations where knobs have been used previously. One of the major reasons for this growing requirement is the growing attention to the needs of the handicapped. Certain handicapped persons can operate a lever handle lockset more easily than a knob operated lockset. In specific addition, the provisions of the Americans With Disabilities Act of 1990 has gone into effect. This provides a federal legislative standard of "providing a broad national mandate for the elimination of discrimination against individuals with disabilities". It includes discrimination in transportation, public accommodations, and the activities of state and local governments. This includes work sites, medical offices, retail establishments, theaters, federal buildings and other structures. It requires that there be barrier-free design and that the places of accommodation be readily accessible and usable. It is estimated that there are 42 million Americans with some degree of disability.

An American National Standard A 117.1-1980, Section 4.27.4 requires that there be door controls, and that the operating mechanisms shall be operable with one hand and shall not require tight grasping, pinching, or twisting of the wrists, and the force required to activate controls be no greater than 5 lbf. American National Standard A117.1-1980, Section 4.13.9, relating to door hardware, requires that locks have a shape that is easy to grasp with one hand and do not require tight grasping, tight pinching, or twisting of the wrist to operate. Lever-operated mechanisms are one of the preferred acceptable designs.

There is therefore a need for a retro-fit kit to enable existing cylindrical locks to be converted to lever-operated locksets. Previous attempts have been made. A serious difficulty with previous attempts relates to the fact that cylindrical locks have been solely for knob operation.

The springs that operate a cylindrical lock are very small. There are only two small compression springs, inside the lock, behind the retracting bar. These two small compression springs are suitable to operate a cylindrical knob lock since there is little torque and the two small compression springs can adequately return the knob and spindles to the original starting position, after the lock has been retracted.

When an attempt was made to add levers to existing unaltered cylindrical locksets, it failed for the following reasons. Since a cylindrical lock was manufactured solely for use with knobs, the construction did not accommodate problems that arise when using levers with a cylindrical lock such as:

(1) Lever sagging because of inadequate internal spring power. After continued use, the small normal internal compression springs in a normal cylindrical lockset would become fatigued and the lock would then sag to a position below the horizontal. Enough sagging would cause the lock to unlatch itself.

(2) The serious damage that can be caused to a normal ANSI Grade 1, 2 or 3 fully cylindrical lockset because of the relatively tremendous torque pressure of a commercial lever which is normally 5" long, compared with knobs which rotate on an axis and with little or no chance of creating enough torque on the internal parts of the lock that will cause it to break or become defective and/or inoperative.

Most of the parts of a conventional cylindrical lockset in ANSI Grades 1, 2 or 3 are of a stamped steel construction. The lock spindles on which the knobs and/or levers are mounted are stamped steel, formed into a cylinder shape. Internal parts like the retracting bar and other major parts of mostly all cylindrical locksets are also stamped steel.

When the cylindrical lock was invented, many years ago, it was not anticipated that it would be used with levers. The light stamped steel parts and construction are adequate and suitable for long and efficient use of the classic cylindrical lockset in ANSI Grade 1, 2 or 3 constructions only in knob locksets.

Even the classic ANSI Grade 1 pure cylindrical lockset is made of mostly stamped steel parts. Even ANSI Grade 1 locksets will not withstand the severe torque pressures of a full length commercial lever mounted in place of various styles of knobs.

Since a pure cylindrical lock contains no positive stops, the lock can be broken if more than a certain amount of torque force is exerted on the lockset when rotating the spindles by either knob or lever operation. Since no positive stops were designed into the basic construction of a conventional cylindrical lockset in any of the three grades, whenever a force created by the rotating of the spindles is greater than a certain amount, it will break up and destroy the lockset. Such breakage and damage will result in distortion of the tubular spindles on which the levers and/or knobs are mounted; breakage of internal stamped steel parts such as the cam on the end of the spindle which activates the retracting bar. Because of the lack of positive stop, there are various other ways that a cylindrical lockset can be broken when using lever operation, instead of knob operation.

Another serious problem that hindered lock manufacturers from successfully converting a conventional ANSI Grade 1, 2 or 3 cylindrical lockset from knob to lever use was the need of a compensating rose feature which is the feature that helps to mount and hold the lock body in the center of the door. The compensating rose feature is necessary because of varying door thicknesses.

Because of the presence of a compensating outside rose on an ANSI Grade 2 or 3 fully cylindrical lock and/or compensating roses on both sides of an ANSI Grade 1 fully cylindrical lockset, it was not possible for lock manufacturers to add spring loaded rosettes to help to increase the spring power in order to help to eliminate the possibility of lever sagging, caused by the increased torque created by a commercial length lever, compared with the very low torque on a cylindrical lockset operating by the rotation of knobs.

Also, the problem of the adding of positive external mechanical stops to the lockset to prevent lock breakage caused by the severe torque when the lock spindles are rotated by the levers could not be eliminated or solved.

In recent years, some lock manufacturers have designed a cylindrical lock with levers, but these locks are not the pure, classic, unaltered, cylindrical lock construction. Instead, in order to try to overcome some of the serious constructional and operating problems, many cumbersome additional parts were added. Still, the resulting products have not totally eliminated all of the existing problems when using a cylindrical lockset with levers, instead of knobs. None have complete positive stops which will protect the basic lock mechanism from being broken or damaged.

Furthermore, because of the additional parts that have been added, such a lockset is much more difficult to install in the door since it requires the disassembling and reassembling of many parts, as compared with the few parts that need to be disassembled and reassembled on the basic construction in a pure cylindrical lockset. It does not result in the most constructionally sound and most efficiently operating lever type cylindrical lockset available. It cannot be retrofitted on all brands of cylindrical locks.

SUMMARY OF THE INVENTION

The present invention has overcome the difficulties in the prior art and it meets the long-standing needs which were inadequately addressed by the prior art, and which have become accentuated further because of increased legislation.

It is an object of this invention to provide a device for converting a conventional knob operated cylindrical lock to a lever lock.

It is another object of this invention to provide a retrofit conversion kit by which an existing unaltered classic cylindrical knob operated lockset may be converted in the field to a lever operated lock in a very short length of time. Estimated installation time is 12–15 minutes.

It is yet another object of this invention to provide a retro-fit conversion kit for light duty, standard duty, and heavy duty cylindrical locksets originally manufactured for ball operation, to lever operation without any possible chance for damage or breakage to the existing lock and with the provision of an attractive appearance.

It is yet another object of this invention to change a knob cylindrical lock to a lever operated lock so as to better serve the needs of the handicapped.

In this invention, no changes are needed in the key cylinder. With this invention, when used as a conversion kit in the field, the existing cylinders and keying can be maintained and are not destroyed. This is a big advantage in time and cost to the end user.

This invention can be used with either a standard five or six pin tumbler cylinder and/or with interchangeable core cylinders and/or with any brand of high security cylinders.

This invention can be applied with the use of either a round rosette or a rectangular escutcheon.

This invention will operate satisfactorily on all different commercial cylindrical lock functions, including entrance key, storeroom, classroom, passage, privacy and all others.

This invention is unique in that the lever and rosette and/or rectangular escutcheon are fixed together as an integrated assembly. This integrated assembly includes a coil spring that will completely eliminate lever sagging. This integrated assembly also includes a disk which acts as a positive stop. Therefore, when rotation of the lever which is located in the back of each of the rosettes and/or rectangular escutcheons reaches a certain degree, equal to the approximate degree at which all cylindrical locks have the latch bolt fully retracted (this occurs at, approximately 60°), the positive stop will block the lever from rotating further which would have caused pressure on the internal lock parts, including the spindles, retracting bar mechanism, etc. As a result of these mechanical positive stops built into the rosettes and/or rectangular escutcheons, the lock has been made totally immune from any lock breakage that is caused by excessive torque force when rotating the lever beyond a 60° rotation.

Another feature of this invention is that both rosettes and the rectangular escutcheon have through bolting mounting studs. Rotating of the lock would cause the latch bolt to retract on an oblique. This would cause the latch bolt to eventually break or jam. The mounting studs on both sides of this lever conversion kit completely eliminates this deficiency.

It is yet another object of this invention to provide a retro-fit lever kit that is very versatile and usable on many models and functions of many brands of cylindrical locks in both heavy and standard duty construction.

Therefore, since there are different slots in different positions on different lever spindles of various brands of cylindrical locksets, this problem is overcome by providing a set of unique cylinder cartridges which will permit the same lever handle to operate locksets regardless of the position on the lever spindles which must be engaged to drive/operate the lock.

Without these unique cylinder shaped drive cartridge adaptors, it would not be possible to engage the same levers to the variety of spindle slots to drive/operate the lock.

These cylindrical drive cartridge adaptors are the part of the lever handle kit that engages the lever handle itself and also engages the lock when the lever is rotated.

This same cylindrical drive cartridge adaptor feature is the part of this patented lever handle conversion kit that engages and drives/operates both a pin tumbler and/or interchangeable core cylinder type lever conversion kit.

Without the use of these cylindrical drive cartridge adaptors, it would not be possible to drive/operate a variety of makes, models and functions of standard and heavy duty pure cylindrical locks with the same lever handle kit.

It is yet another object of this invention to provide the possibility of changing the keying of a pin tumbler cylinder whenever it becomes necessary. This invention has simplified the method of changing the pin tumbler by a unique new method. This invention completely eliminates the changing of a pin tumbler cylinder by the conventional method. The conventional method is by the removal of the knob and/or lever via an external spring lock clip. The changing of pin cylinder with this lever handle conversion kit is done by merely putting the pin tumbler cylinder in by dropping it down the lever shaft from the back of the lever. By this mounting technique, it completely eliminates the spring lock mechanism on the spindle of the lock body. This method offers much greater security than the old original method since the cylinder is not at all accessible from the outside of the lock as it is under the old conventional method, but instead, the cylinder is completely entombed inside of the lever handle. There is no direct access to the removal of the cylinder from the outside of the lock. Instead, the cylinder can only now be removed by the removal of the through bolt mounting.

It is yet another object of this invention to preserve the possibility of maintaining the pin tumbler cylinder in the correct upright position when the lever handle lock may be reversed form right hand to left hand or left hand to right hand operation. This lever handle kit has been designed to permit the reversing of the hand of the lock and to still maintain the cylinder the correct position, namely, with the pin tumbler chamber up. All of the modified cylindrical locksets that have entered the market in recent years do not preserve the pin tumbler cylinder's being maintained in an upright position. Instead, the cylinder is being positioned horizontally. It is a known fact that the pin tumbler cylinder should always be installed vertically with the pins at the top since they operate by gravity and by the use of very small springs which are placed behind the pin tumblers in the cylinder chamber. This invention preserves the proper, correct position of the pin tumbler cylinder when the lock is installed on the door.

It is yet another object of this invention to provide a much stronger and more efficient arrangement of the bearing surfaces of the lever handle, roses and lock spindle.

Since all classic cylindrical locks in all three grades have quite a bit of vertical and lateral play between both lock spindles and the roses and levers and/or knobs, this invention has totally eliminated all of these deficiencies.

This invention provides a long motor type shaft bearing surface arrangement which has nearly no vertical or lateral play whatsoever between the lever, the rose and the lock spindle.

It is an object of this invention to design a novel arrangement of all of the external parts and accessories into an integrated assembly which, when combined with the standard classical cylindrical lock results in an upgraded cylindrical lockset with all of the former constructional and operational deficiencies totally eliminated. This invention has entombed the cylindrical lockset body in a way that is now immune to external pressures and/or possible damage while being permitted to operate in an efficient manner.

DESCRIPTION OF THE PREFERRED EMBODIMENT

Figure 5:
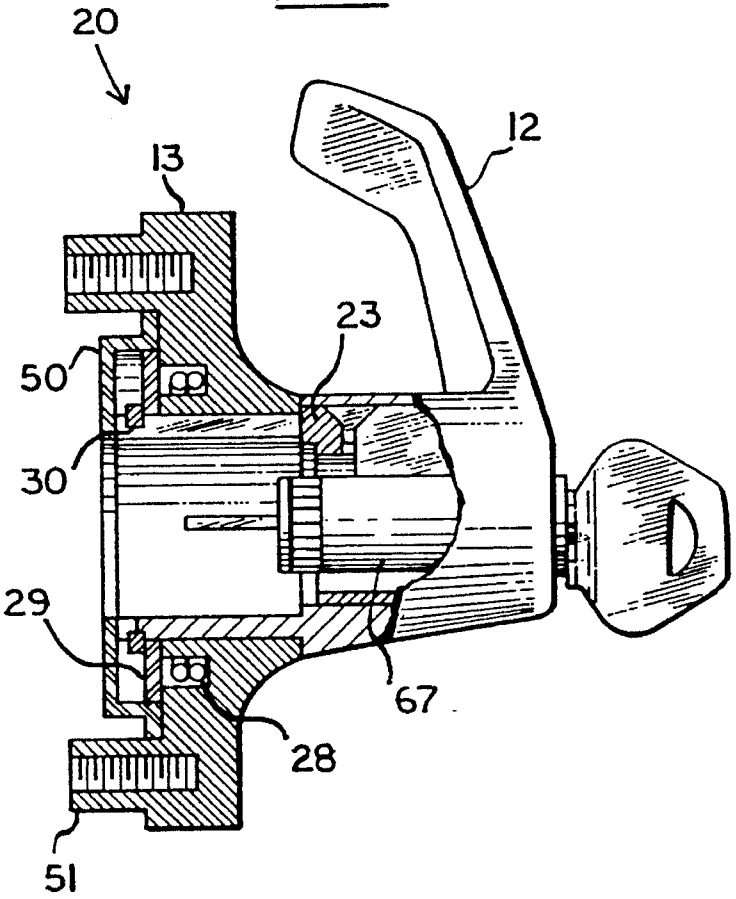
FIG. 5 is a partially fragmented, partially cross-sectional view of the lever rosette assembly, taken on a vertical plane through the longitudinal axis of the assembly of FIG. 2, as assembled.

A feature of this invention is that the lever and rosette and/or rectangular escutcheon are fixed together as an integrated assembly. This integrated assembly includes a coil spring that eliminates lever sagging. This integrated assembly also includes an inside positive stop disk 27 which provides a positive stop. Therefore, when rotation of the positive stop disk 27 which is located in the back of each of the rosettes and/or rectangular escutcheons reaches a certain degree, equal to the approximate degree at which cylindrical locks have the latch bolt fully retracted (this occurs at approximately 60°), the positive stop disk 27 will block the lever from rotating further. This prevents pressure on the internal lock parts, including the spindles, retracting bar mechanism, etc. The positive stop thus avoids lock breakage caused by excessive torque force when rotating the lever beyond a 60° rotation.

Another preferred feature is that both rosettes and the rectangular escutcheon have through bolting mounting studs; stud 51 on the outside escutcheon and stud 52 on the inside escutcheon. The mounting studs 51 on the outside escutcheon or rosette are provided witch internal threads 54 to receive and secure the through bolts 53. Without these studs, rotating of the lock could cause the latch bolt to retract on an oblique. This could cause the latch bolt to eventually break or jam. The mounting studs on both sides of this lever conversion kit completely eliminate this deficiency.

The invention provides a retro-kit lever kit that is very versatile and useable on many models and many brands of cylindrical locks in both heavy and standard duty construction.

Since there are different slots in different positions on different lever spindles of various brands of cylindrical locksets, a set of differing configuration cylinder shaped drive cartridge adaptors are provided which permit the same lever handle to operate locksets regardless of the position on the lever spindles which must be engaged to drive/operate the lock.

Without these cylinder shaped drive cartridge adaptors, it would not be possible to engage the lever to the variety of spindle slots to drive/operate the lock.

The drive cartridge adaptors are the part of the lever handle kit that engages the lever handle itself and also engages the lock spindle which then drives/operates the lock when the lever is rotated. The drive cartridge adaptor engages and drives/operates both a pin tumbler and/or removable core cylinder type lever conversion kit.

This invention provides the possibility of changing the keying of a pin tumbler cylinder whenever it becomes necessary. This invention has simplified the method of changing the pin tumbler cylinder. It eliminates the changing of a pin tumbler cylinder 67 by the conventional method. The conventional method is by the removal of the knob and/or lever via an external spring lock clip 63 on the outside spindle and external spring clip 64 on the inside spindle. The changing of pin tumbler cylinders with the lever handle conversion kit of the present invention is done by merely installing the pin tumbler cylinder via the outside shaft or sleeve or spindle 85 of the lever handle kit by inserting it through the back of the lever handle.

This invention permits maintaining the pin tumbler cylinder in the correct upright position when the lever handle lock is reversed from right hand to left hand or left hand to right hand operation. It permits reversing the hand of the lock while still maintaining the cylinder in the correct position, that is, with the pin tumbler chamber up. Conventional modified cylindrical locks with levers do not preserve the pin tumbler cylinder being maintained in an upright position. Instead, the cylinder is conventionally positioned horizontally. A pin tumbler cylinder preferably should always be installed vertically with the pins at the top since they operate by gravity and by the use of very small springs which are placed behind the pin tumblers in the cylinder chamber. This invention preserves the proper correct position of the pin tumbler cylinder when the lock is installed on the door for either right hand or left hand operation.

Figure 1:
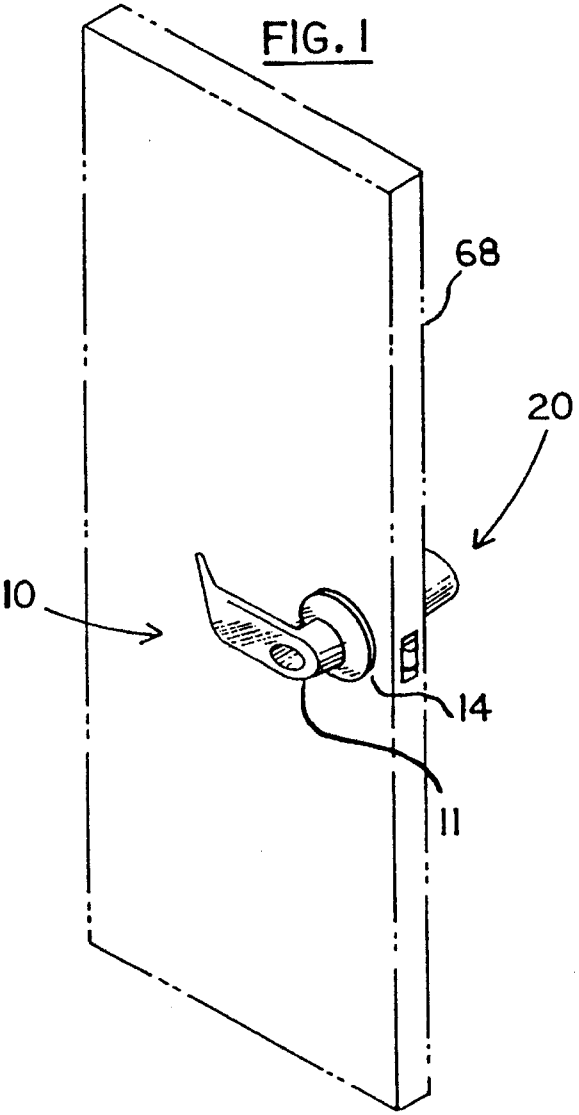
FIG. 1 is a perspective view of a converted lever-handle lockset mounted on a door.
Figure 8:
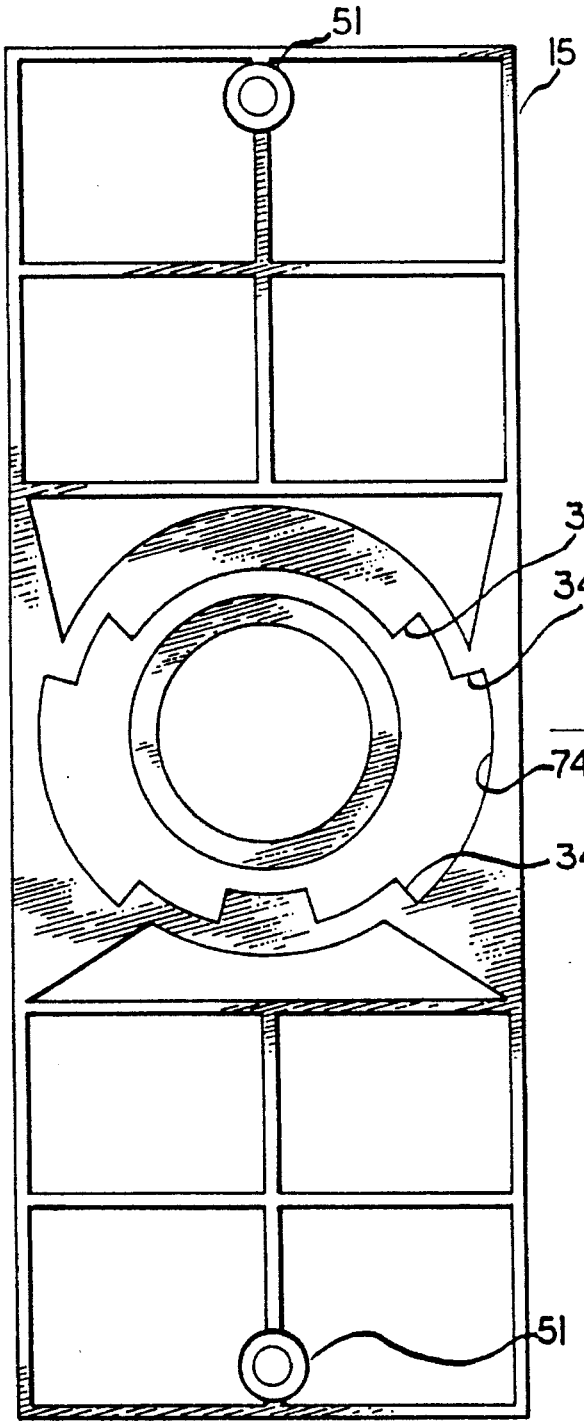
FIG. 8 is a front elevation view of the inner surface of an escutcheon.
Figure 9:
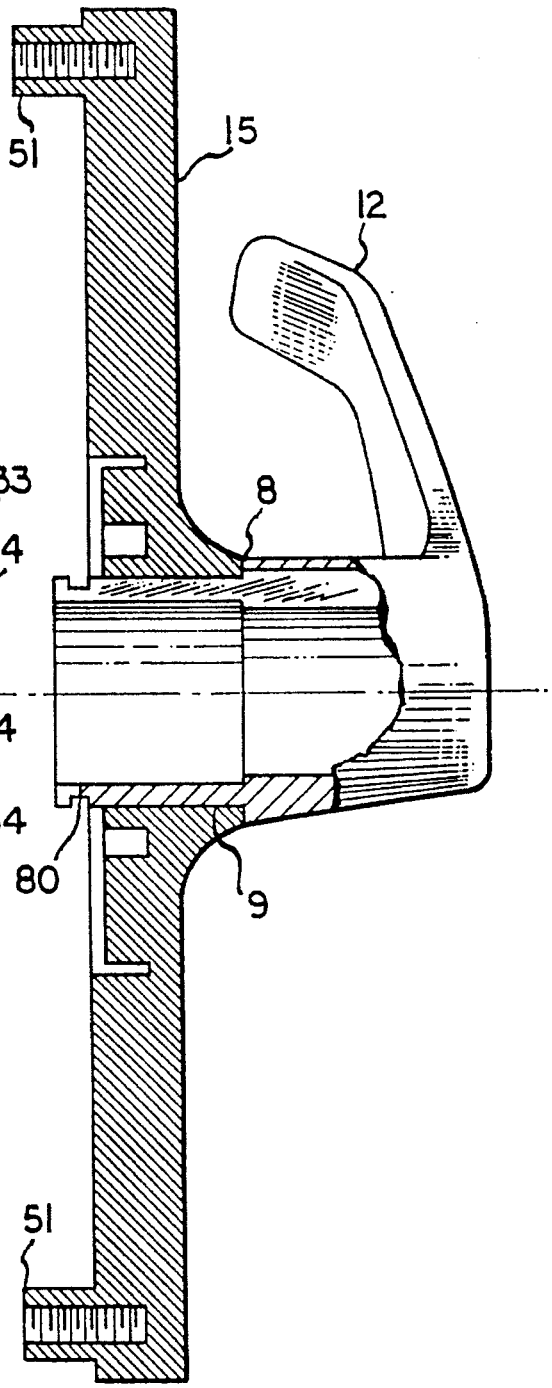
FIG. 9 is a partially fragmented, partially cross-sectional view of a lever escutcheon assembly, taken on a vertical plane through the longitudinal axis, as assembled.

The broad environment of the present invention is best shown in FIG. 1. A completely installed converted inside lockset generally designated 10, is shown in a door 68, shown in phantom view. It includes a lever handle 11 on the inside of the door and a lever handle 12 on the outside of the door. An inside rosette 14 is shown. In other figures, as FIGS. 8 and 9 for example, the equivalent element is shown as escutcheon 15. Generally, the element is called a rosette if it has a round or circular configuration, and is called an escutcheon if it has a square, rectangular or more angular configuration. The terms are used interchangeably herein and a reference to either one is considered to include the other.

Figure 11A:
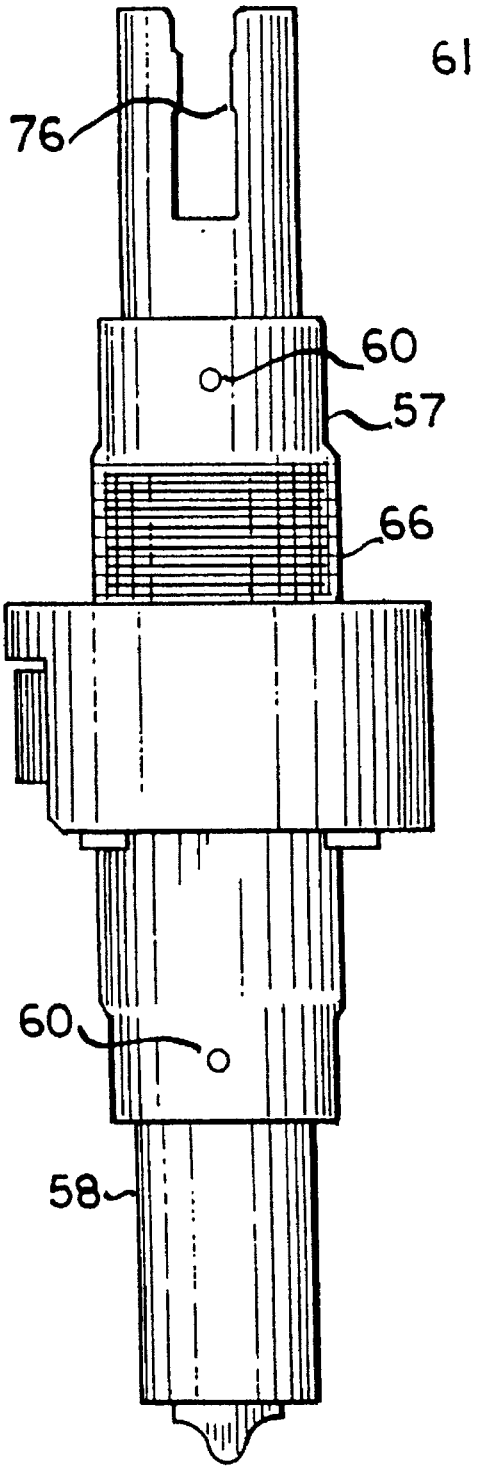
FIGS. 11*a* and 11*b* are classic ANSI Grade 1 and ANSI Grade 2 cylindrical lock bodies respectively.
Figure 11B:
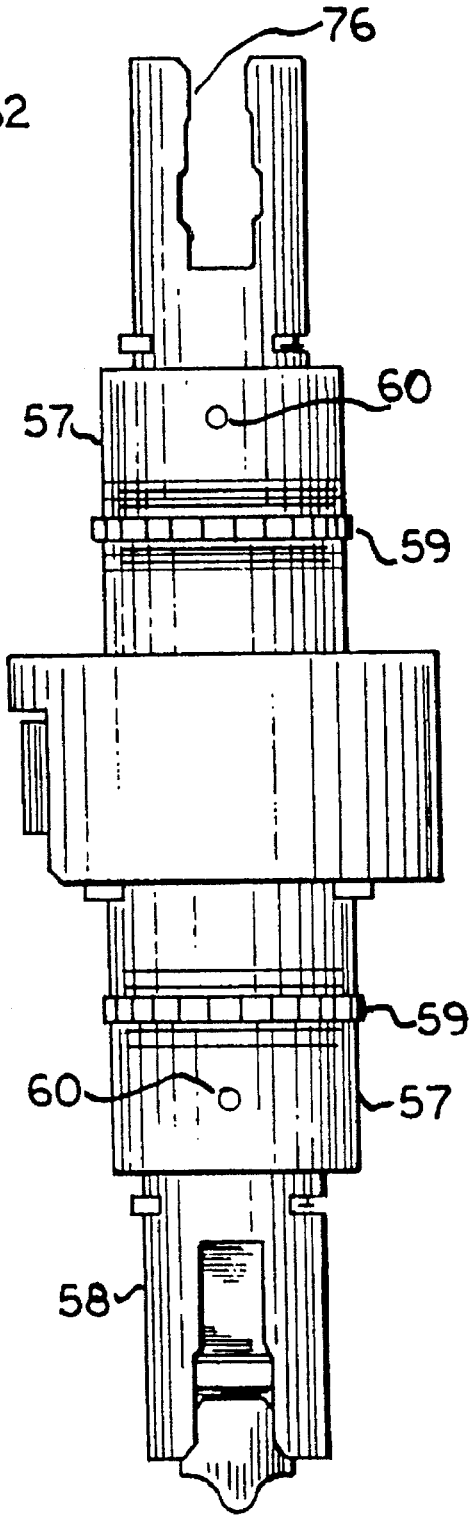

The broad concept of the invention may be best initially described in connection with FIG. 2. The door, 68, is initially provided with a knob operated cylinder lock which is to converted to a handle cylinder lock. The knobs and the original rosettes are removed, as is also the inside mounting plate. The remaining portions of the original cylindrical lock unit, generally designated as either 61 (ANSI Grade 2) or 62 (ANSI Grade 1) in FIGS. 3 and 11, include the pin tumbler cylinder itself 67, provided with a longitudinally extending key or tab 70, the latch bolt 71, the strike on the frame (not shown), and the lock tubular spindles 79. These remaining portions of the original lockset (except for cylinder 67) are generally shown in phantom lines in FIG. 2.

Figure 2:
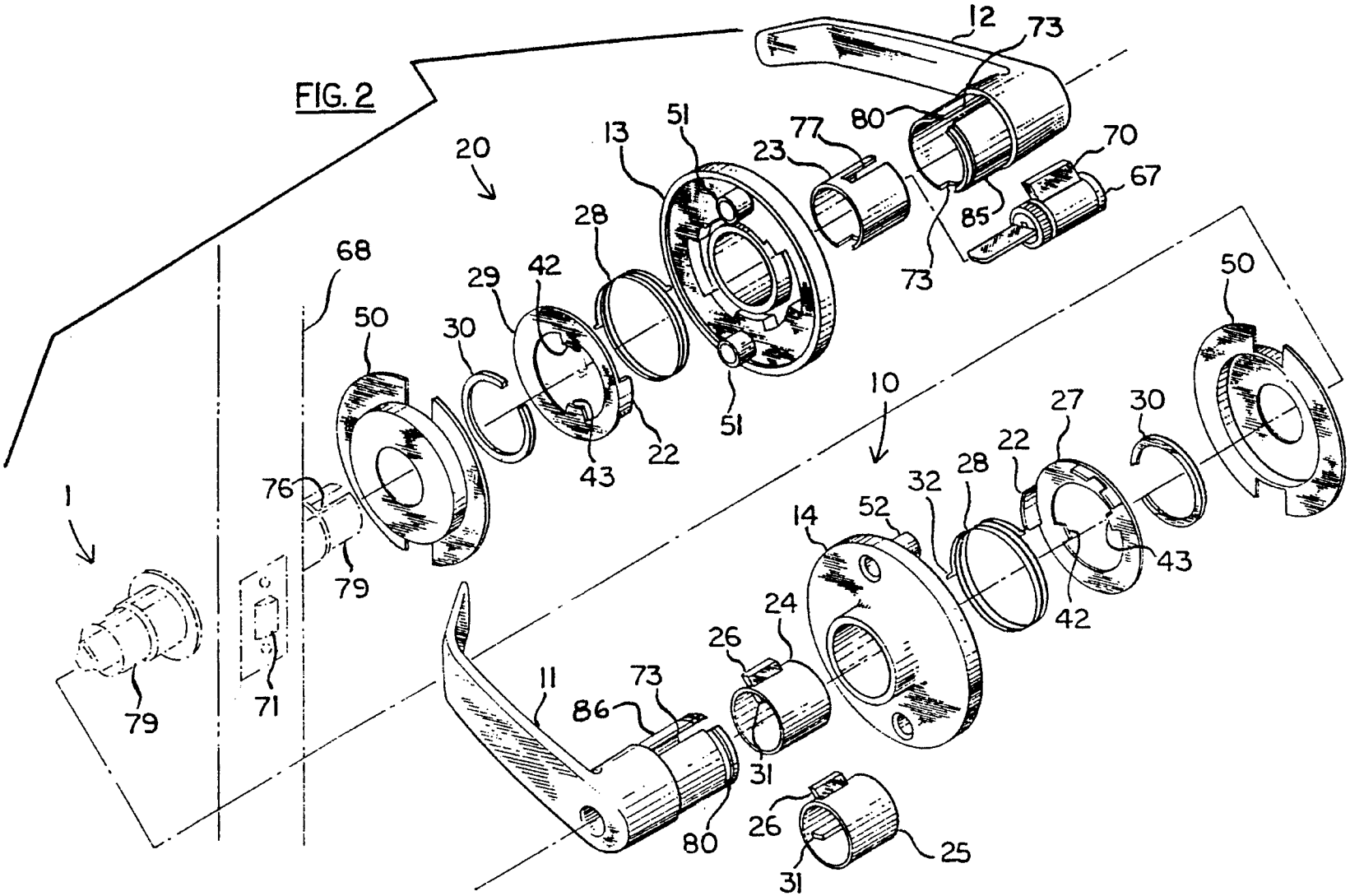
FIG. 2 is an exploded view of the lever conversion assembly.

In FIG. 2, the original rosettes and the knobs have been removed, and the elements of the conversion kit of the present invention are shown in exploded view to better illustrate how the installation is made on both sides of the door 68.

The following items form the integrated lever rose assembly: lever 12, outside rosette 13, helical coil spring 28, outside positive stop disk 29 and retainer spring clip 30. These parts are shown in exploded view in FIGS. 2 and 4 and assembled in FIG. 5.

Figure 4:
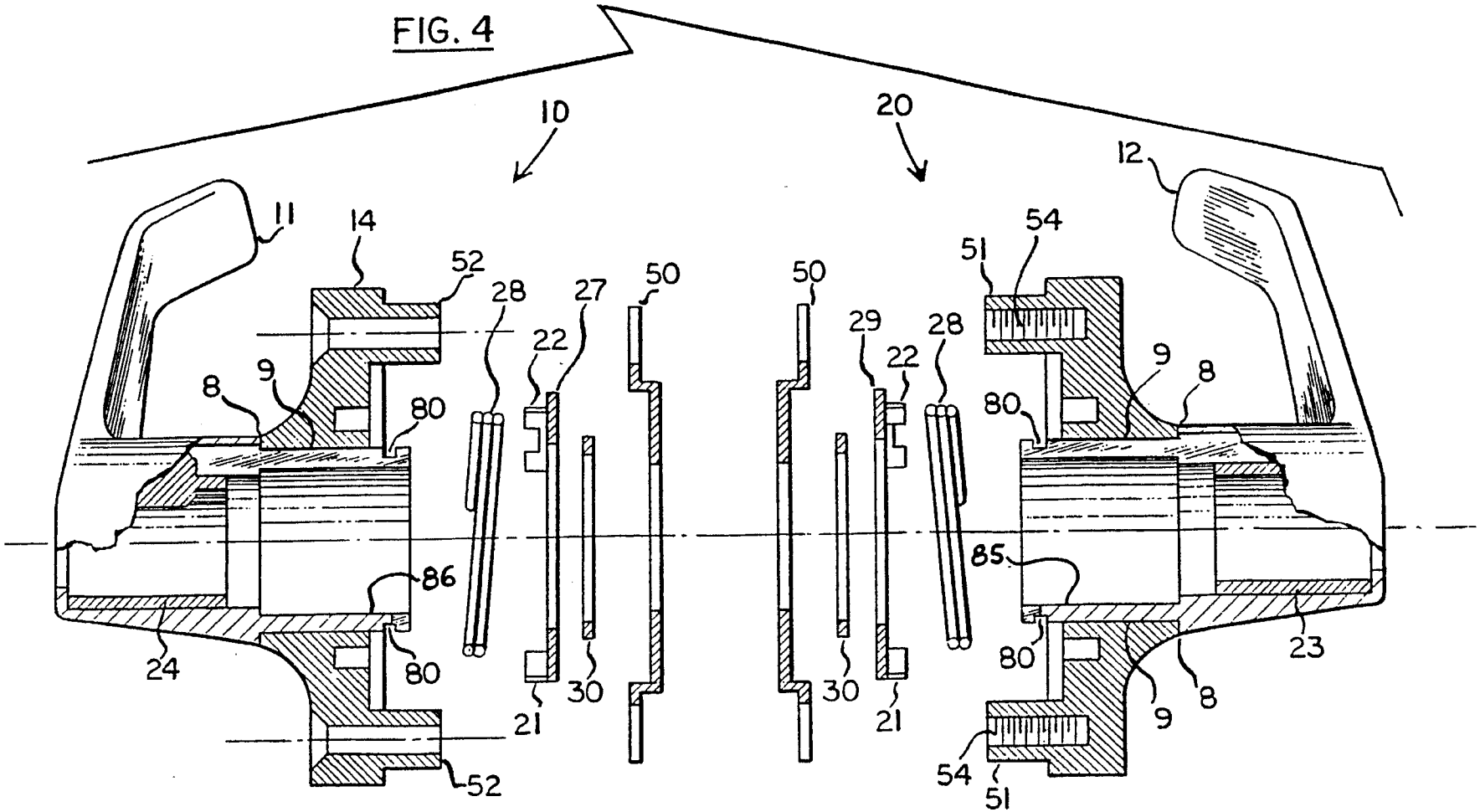
FIG. 4 is a cross-sectional exploded view, taken vertically through a longitudinal axis through the exploded assembly as shown in FIG. 2.

They are also shown in exploded view in FIG. 2 and in a cross sectional exploded view taken vertically through a longitudinal axis through the exploded assembly in FIG. 4. These five parts are assembled as an integrated assembly on both sides of the door.

When assembled, rosette 13 and lever 12 form an assembly which has a long inwardly extending shaft or sleeve or spindle 85 with a bearing surface 9 and a ring bearing surface 8 between lever 12 and rosette 13, as shown in FIG. 4.

The combination of mounting studs 51 and 52, fastened by the use of through bolts 53 eliminates all lateral and vertical movement between the lever 12 and rosette 13 and the main cylindrical lock unit 61 or 62. An outside handle 12 is provided. It includes a long shaft or sleeve 85 with two drive slots 73. An outside adaptor 23, also called an outside drive cartridge adaptor cylinder 23, is provided. In practice, in a kit, there are a plurality of such drive cartridge adaptor cylinders 23, having a different configuration of slots or teeth. The purpose is to make the kit universally useful to fit existing locksets having different slots on the spindle or teeth on the end of the spindle which are part of the cylindrical lock itself.

Cylinder 67 is inserted in the back of the lever and the longitudinally extended tab 70 engages the lever handle spindle drive slot 73. Then drive cartridge adaptor cylinder 23 is installed into the shaft or sleeve 85 of the lever 12 and also engages extending tab 70.

The tubular lock spindle 79 is inserted into the lever shaft or sleeve 85 and the spindle drive slot 76 engages the cylinder 67 by means of key or tab 70. When lock 61 or 62 is integrated and assembled with the completely assembled inside lever rose kit 10 or outside lever rose kit 20, the lever assembly 10 or 20 will now drive the cylindrical lock 61 or 62.

An escutcheon or rosette 13 is provided. In FIG. 2, much of the important internal structure of rosette 13 is omitted. A circular helical coil spring 28 is provided. A stop disk 29 is provided. A split ring retainer 30 is provided. The elements 28, 29 and 30 are nestled in assembled relationship within the confines of rosette 13. A lock mounting rose plate 50 is provided. A plate 50 fits up against the lock body and door and keeps the lock body in the center of the door. In the present invention, it is configured with an appropriate recess in its outer-facing side so as to permit the operation of the mechanism contained within rosette 13. The inside and outside plates 50 are identical.

On the other side of the door, a handle 11 with the same configuration as lever handle 12 is provided. Handle 11 is provided with an inwardly extending shaft or sleeve or spindle 86 which has a longitudinal slot 73 and a circumferential spring clip groove 80. An inside drive cartridge adaptor cylinder 24 is provided. Drive cartridge adaptor cylinder 24 has an externally projecting key or tab 26 which engages the lever handle spindle 86 drive slot 73, while an alternate drive cartridge adaptor cylinder 25 has an inwardly projecting key or tab 31 which engages the spindle slot 76 in the inside lever sleeve or spindle 86. On some models of cylindrical locks, drive cartridge adaptor 25 is needed since the inside drive cylinder key is located in the proper position to engage the spindle or sleeve 86 drive slot 76.

The combination of lever 11 with drive cartridge adaptor 24 or drive cartridge adaptor 25 is assembled with the cylindrical lock body and engaged with the lock spindle drive slot 76. The lever will now rotate the cylindrical lock 61 or 62 and retract the cylindrical lock latch bolt 71.

Operating either lever will rotate the cylindrical lock spindles and rotate the latch bolt.

The immediately foregoing description relates to an embodiment in which the lockset is intended to key-locking, as an exterior lock, and is provided with a key cylinder 67. The principle of this invention may also be applied to a lockset that does not include a key cylinder 67; that is, an interior lockset or privacy lock, sometimes commercially described as a bath or bedroom lock. In the embodiment wherein no key cylinder 67 is used, reference to FIG. 2 indicates the configuration that would be made. In place of key cylinder 67, an adaptor 24 is provided. The structure of adaptor 24, as shown, is the functional equivalent for connecting and driving purposes (although of course not for locking purposes) of the key cylinder 67. On the other side of the door, in connection with handle 11, either adaptor 24 or adaptor 25 is provided, depending on the cut of the spindle on the handle, as has been described. Thus, in summary, if a key cylinder is used, the tabless drive cartridge adaptor 23 is used in conjunction with it, as shown at the upper right hand portion of FIG. 2, and either drive cartridge 24 or 25 is used in conjunction with the other handle, as shown at the lower portion of FIG. 2. In the case in which no key cylinder 67 is used, then drive cartridge adaptor 24 replaces both it and the tabless drive cartridge adaptor 23. In this case also however, in conjunction with the other handle 11, at the lower portion of FIG. 2, either drive cartridge adaptor 24 or 25 is used as has been described.

It is thus clear that while this invention contemplates field changes between handles and knobs and field changes of key cylinders, it also contemplates field changes between key operated locks (as exterior locksets for example) and non-key operated locks (as privacy locks or bath or bedroom locks for example). For the purposes of providing a terminology that covers both the key cylinder and the non-key cylinder embodiments as described, the tabbed key cylinder 67 and the tabless drive cartridge adaptor 23 are together called a primary cylindrical tabbed drive structure. In the embodiment in which there is no key-operated key cylinder, and in which the tabbed drive cartridge adaptor 24 replaces the tabbed key cylinder 67 and the tabless drive cartridge adaptor 23, the tabbed drive cartridge adaptor 24 is also termed a primary cylindrical tabbed drive structure.

Figure 6:
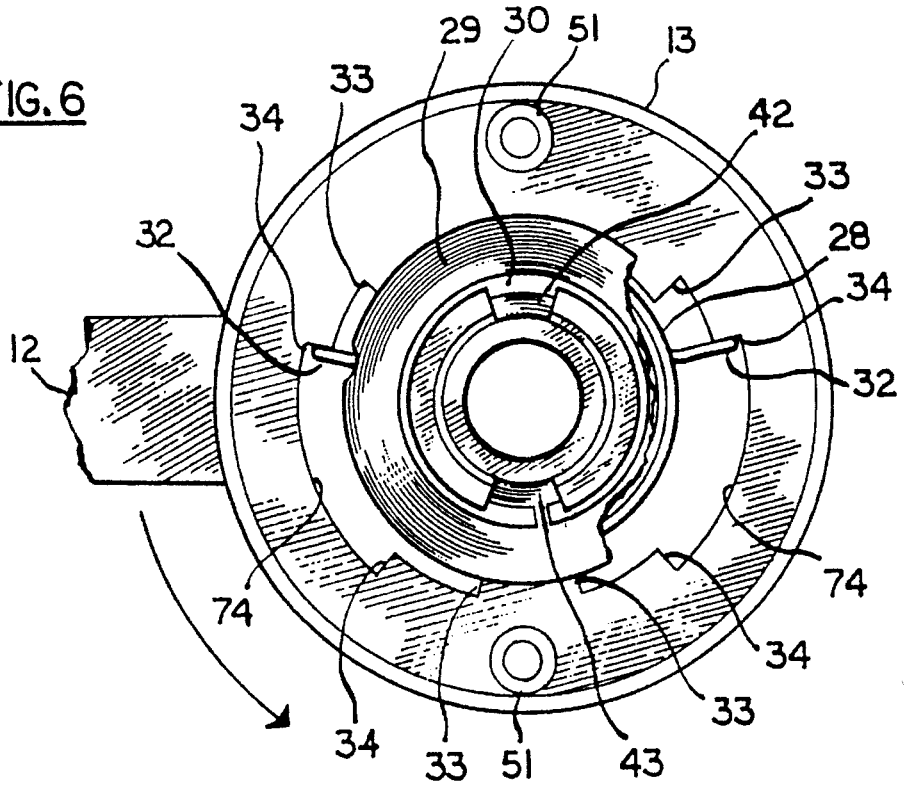
FIG. 6 is a front elevation view of the inner surface of a rosette or escutcheon with the operating handle in the horizontal position.
Figure 7:
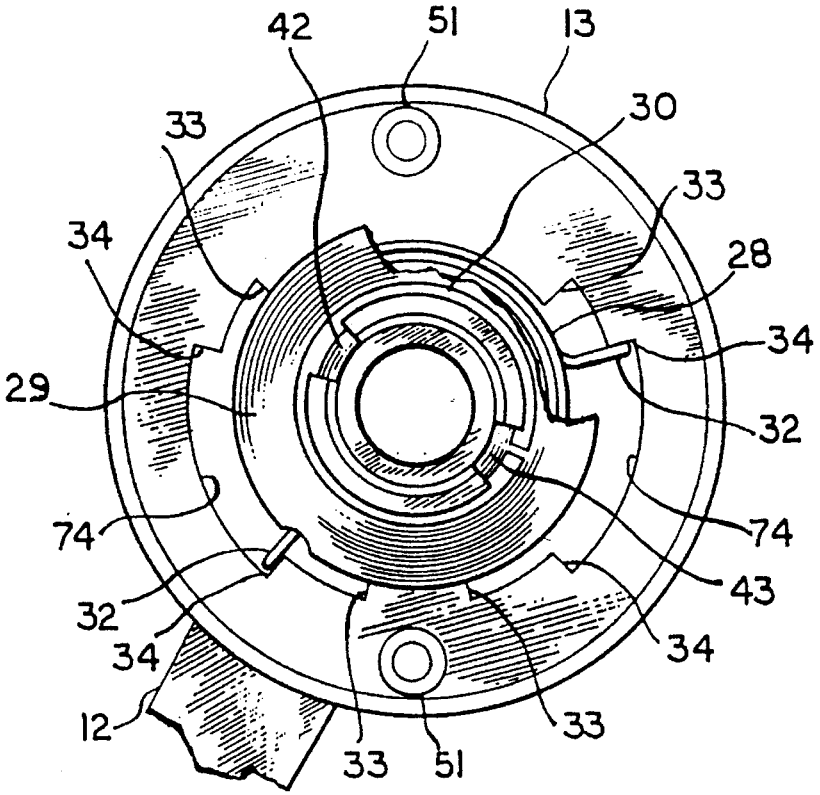
FIG. 7 is a front elevation view of the inner surface of a rosette or escutcheon with the operating handle in the depressed position.

The rotation of either lever 11 or 12 cannot exceed 60° since the rotation will be stopped by the action of the positive stop disk 29 when the cam 22 on the positive stop 29 reaches the rosette positive stop barrier 33 as shown in FIG. 7. FIG. 6 and FIG. 7 show how the positive stop 29 operates. The disks 29 and 27 function and coact with other elements in the same way.

The inside lever rose assembly 10 is assembled in the same way as the outside lever rose assembly 20.

The rosette or escutcheon 14 contains the spring 28, positive stop disk 29 and retainer spring clip 30.

Lock mounting plates 50 are also provided on the inside and outside of the door and each operates in the same manner. Both lock mounting plates 50 are held in position underneath of the rosettes 13 and 14 and held in position by the rosette mounting studs 51 and 52.

Figure 3:
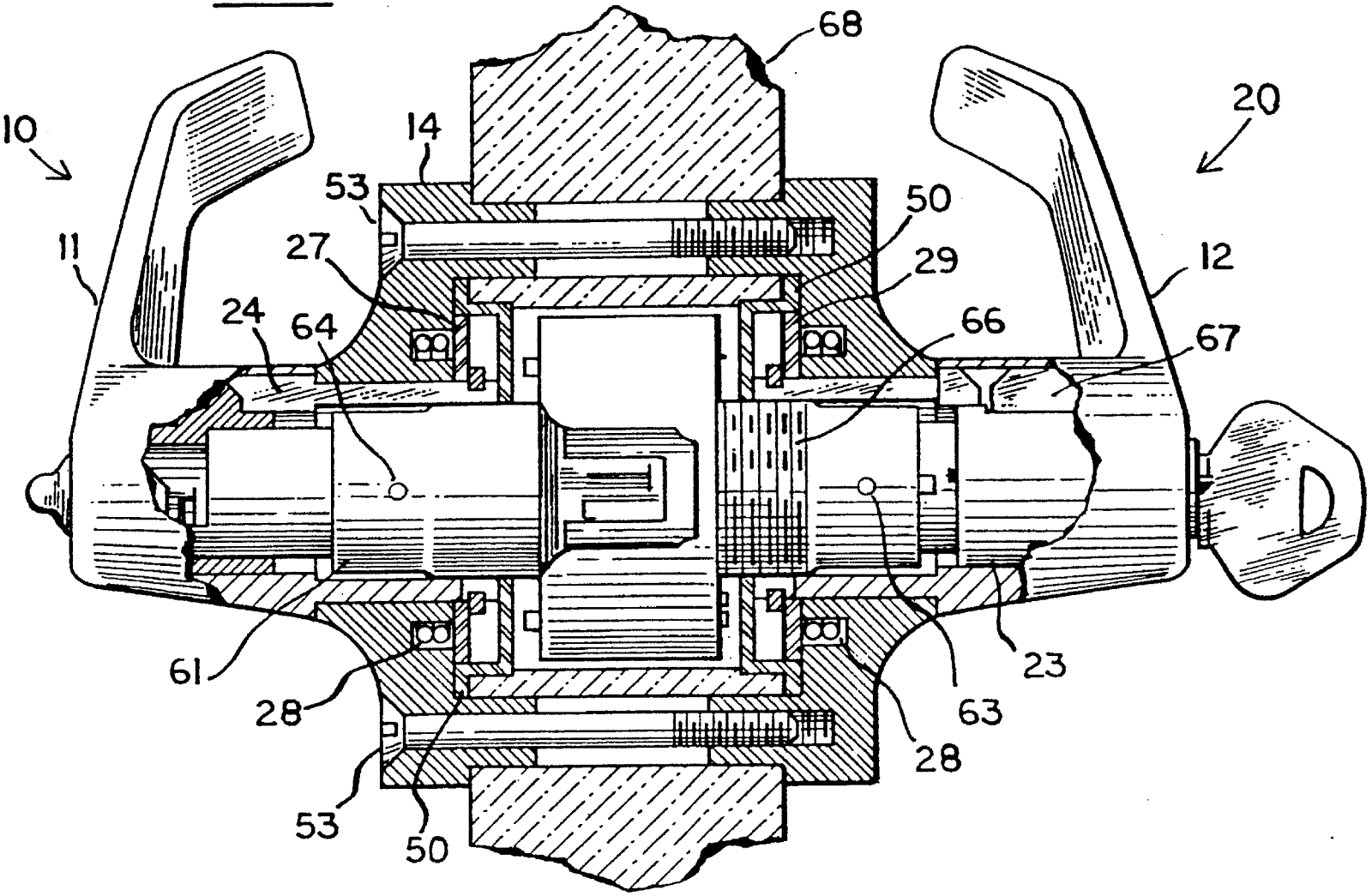
FIG. 3 is a partially fragmented view, partially in central vertical cross-section of a standard cylindrical lock provided with the lever handle/rosette conversion kit.

FIG. 3 shows the complete lever handle conversion kit mounted on a door with a classic cylindrical lock 61 (ANSI Grade 2). An ANSI Grade 1 cylindrical lock unit 62 may be substituted for lock unit 61.

This invention eliminates the use of the spindle lock assemblies 63 and 64.

This invention also eliminates the use of the threaded collar for compensating roses (ANSI 1) 59 and threaded collar for compensating roses (ANSI 2) 66 which are no longer needed in this invention.

FIG. 3 shows a cut-open view of the arrangement of all parts of this invention when installed on a door with a classic cylindrical lock unit.

With reference to FIG. 2, more detailed structure and action of the invention may be described. The drive cartridge adaptor cylinder 23 is provided with a slot 77. The appropriate configured adaptor 23 is selected by the installer so as to properly fit the configuration of the cylindrical lock spindle 79 as shown in FIG. 2. The slot 77 in adaptor 23 aligns with the slot in the spindle 79 and receives the key or tab 70 on the cylinder 67. Thus, an operating driving coaction is provided from the handle 12 to the lock cylinder 67, whereby the lock may be operated. The adaptor also operatively fits and coacts with the shaft or sleeve 85 of the lever 12. A provision of a number of alternate types of drive cartridge cylinders 23 makes this possible.

In broad terms, it is the coiled helical spring 28 which provides the additional bias or resistance against torque needed to carry out the purposes of the present invention. As has been described, when a knob is replaced with a lever, the small internal springs in the cylindrical locks 61 and 62 have been found not to be strong enough to prevent the lever 12 from sagging from its own weight and not to be strong enough to withstand the increased movement forces exerted on cylindrical locks 61 and 62 when the user operates a lever 12 rather than a knob. The reason for the increased torque is that the lever handle 12 has a much longer movement arm than a knob. Therefore, on the classic knob operating cylindrical lock the internal two small compression springs, behind the retracting bars of the cylindrical lock are adequate to operate the lock properly.

In addition to the elastic action of spring 28, another protective aspect is the provision of the positive stop disks 27 and 29. The action of this positive stop disk, in connection with internal structure of the rosette 13, provides limits, barriers or stops to prevent excessive rotation of the lever handle. The retainer spring clip 30 is preferably a spring ring which serves to hold the above-described elements 28 and 29 and elements 28 and 27 in place within rosettes 13 and 14, respectively.

The most detailed interaction of some parts of this invention are, perhaps, best understood in connection with FIGS. 3, 4, 6 and 7 considered together. The discussion of elements for one side of the door is generally applicable to the corresponding elements intended for the other side of the door unless otherwise specified.

The helical coil spring 28 has its ends bent outward into projecting nibs or tabs or extensions 32. These nibs 32 are the means by which the spring 28 can be put under elastic stress by forcing the nibs either closer together or further apart. Before describing an embodiment of exact structure, the general function and structure of the spring 28 is described. With the lever 12 in a horizontal position as it is when the lock is not being operated, the spring is in just enough elastic stress to oppose and prevent any drooping or sagging of the lever. One nib is against a stationary part of the rosette and the other nib is against a part that rotates with the lever handle 12. Thus, any tendency of the weight of the lever 12 to droop or sag from the horizontal produces increased stress in the spring and, hence an opposing force to the droop. When the lever 12 is rotated downward from the horizontal as it is when the lock is operated, a cam 22 on the positive stop 29 rotates with the lever and exerts a force on the other nib 32. This changes the relative circumferential positions of the two nibs 32 and stresses the spring 28 further which provides a force opposing the force on the lever being exerted by the operator. Thus, these two actions of the spring (opposing droop and opposing the operating motion) both supplement the spring action of the cylindrical lock itself.

As perhaps most clearly shown in FIGS. 6 and 7, the inner surface of rose 13 is provided with a pair of circumferentially opposed recessed slots 74. Each end of each of the slots terminates in a stop 34. The length of slot 74 defines the spring nib traveling distance.

The rose 13 has a large central aperture which receives the spindle of the lever 12 and surrounds the lock cylinder 67. Preferably, there is a narrow fully circumferential recess around the aperture to accommodate the full circumferential extent of the spring 28. The extended nibs 32 of the spring are accommodated in the preferably wider recessed opposed slots 74.

The positive stop disks 27 and 29 are each provided with a cam or extension 22 which extends at a right angle to the plane of the positive stop disks 27 and 29 and towards the inner surface of the rosette 13 only. While a right angle extension is preferred, the cams may be at any angle to the plane within the spirit of the invention and they may be described as angled cams. Each disk 27 and 29 also has a spring holder 21. In the normal unoperated position with the lever 12 horizontal, one of the nibs 32 bears against one of the stops 34. A cam 22 on the positive stop 29 bears against the other nib 32 which does not initially bear against a stop 32. The spacing is such that the nibs are initially slightly moved relative to each other from the position they would take, if the spring were completely unstressed and unbiased. Thus, there is a small initial force opposing the downward movement of the lever 12, sufficient to prevent droop of the lever, as desired.

When the lever 12 is depressed to operate the lock or latch, the positive stop disk 29 rotates with it, by means described below. As the positive stop disk 29 rotates with depression of the lever 12, the cam 22 exerts an increasing force against the nib 32 against which it bears, changing its circumferential position relative to the other nib 32 and increasing the stress in spring 28 and hence the force opposing the operator's applied force as desired.

In addition, as the lever 12 is continued to be depressed downward, the cam 22 on the stop disk bears against a nib 32 and traveling in a slot 74, reaches a stop or barrier or limit 34 at the end of the slot, and thus a positive limit to the angle of rotation of the lever is provided, as desired to protect the lock mechanism and especially the light compression springs inside of the main lock body.

The positive stop disk 29, in addition to having the cam 22 normal to its plane, has drive tabs 42 and 43. These drive tabs 42 and 43 are inward extensions in the plane of the positive stop disk 29. They fit into the ends of the slots 73 on the lever cylinder tube. The split ring retainer 30 snaps onto the end of the lever shaft or sleeve or spindle 85 spring clip groove 80. These circumferential grooves 80 are best shown in FIG. 4. As has been described, the drive cartridge cylinder 67 engages the tab 70 of the lock cylinder adaptor 67 and is configured to fit the lock spindle 79. The old original compensating roses and mounting plates 50 of this invention are installed, as best shown in FIG. 2. The recesses in the lock mounting plates 50, as best shown in FIG. 3 and FIG. 4, assure that there is no interference with the operation of the mechanism now incorporated in the roses.

While most of the above disclosure has been in connection with the elements as shown on the right side of FIG. 2, it is recognized that the inside lever 11 and the drive cartridge cylinder 24 are analogous to the lever 12 and outside drive cartridge cylinder 23 on the right side of FIG. 2. The general principles and functions apply to each side. In FIG. 4, the assembly of elements for the right side (the outside) is generally designated 20 and the assembly of elements for the left side is, generally, designated 10.

It is understood that parts may be separable or integral as a matter of choice without departing from the spirit of the invention. It is under:stood that dimensions, measurements and outward configurations and appearance may vary without departing from the spirit of the invention. It is understood that the kit or assembly of this invention is adapted and intended to provide a conversion from a knob type cylindrical lock to a lever handle cylindrical lock in the field, in situ, and is applicable and will integrate with a wide variety of such locks of many different manufactured brands.

This invention may be used with a classical ANSI Grade 1, 2 or 3 cylindrical lockset and will result in a complete lever operated cylindrical lockset. It is, therefore, understood that this invention, when combined with a cylindrical lock body in any of the three grades, will result in a complete lockset to be used where a retrofit application is not required but, instead, a complete lever handle cylindrical lockset is desired.

Figure 10:
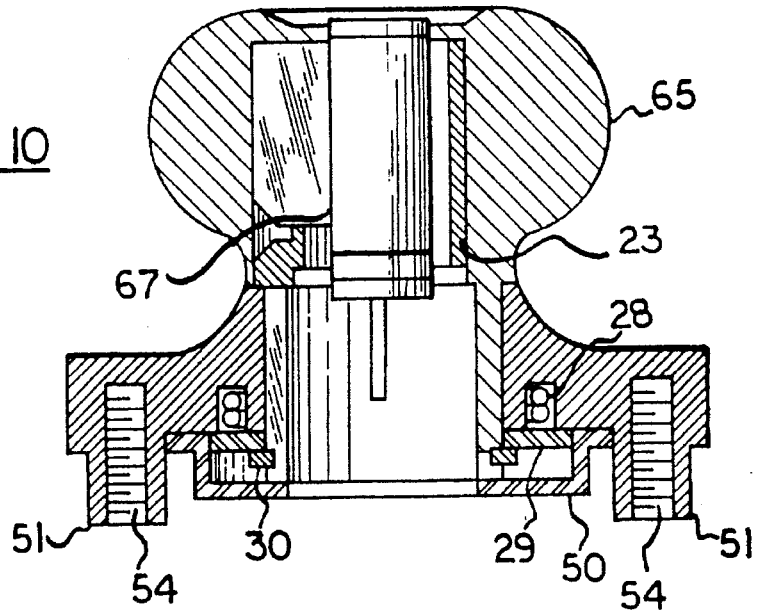
FIG. 10 is a partially fragmented, partially cross-sectional view, taken on a vertical plane of a knob rose assembly, as converted with the conversion kit.

This invention can be used as either a retrofit and/or complete cylindrical lockset that is knob operated as shown in FIG. 10. In FIG. 10, the knob is designated 65, and the other elements are the same as those having the same reference numerals as are described elsewhere in this patent.

The advantage of this invention, when used as a knob operating cylindrical lock, is that the complete knob operating cylindrical lock has numerous constructional and operational advantages and security features, compared with the classical knob operated cylindrical lock. This invention eliminates the need of the spring lock assemblies that lock the key cylinder in the knob and, also, locks the knob on the lock spindles 58.

This invention also eliminates the necessity of the compensating screw rose threads 59 since the complete knob rose assembly, shown in FIG. 10, overrides the spring lock assembly 60 and also, the threads for the compensating roses 59. Therefore, when the complete knob rose assembly 40 is combined with an ANSI Grade 1, 2 or 3 cylindrical lock body to form a complete knob operating cylindrical lock, the manufacturing process for the cylindrical lock body can be greatly simplified to eliminate unnecessary costly features, including the spring lock assembly 60, the threads for the ,compensating roses 59 and the spindle collars 57.

The elimination of these parts both simplifies a complete knob and/or lever operating cylindrical lock, and also results in cost savings by eliminating these lock parts.

The resulting retrofit and/or complete knob operating cylindrical lockset, when using this invention, is more efficient in operation, more secure in respect to the internal positioning of the cylinder, and is not accessible from the outside.

This invention, as either a retrofit and/or a complete knob operating or lever operating cylindrical lockset, permits manufacturers of decorative knobs and levers to incorporate these products with a cylindrical lockset. To retrofit decorative knobs or levers to any brand of cylindrical locksets has not previously been possible but is now possible with this invention.

Figure 14A:
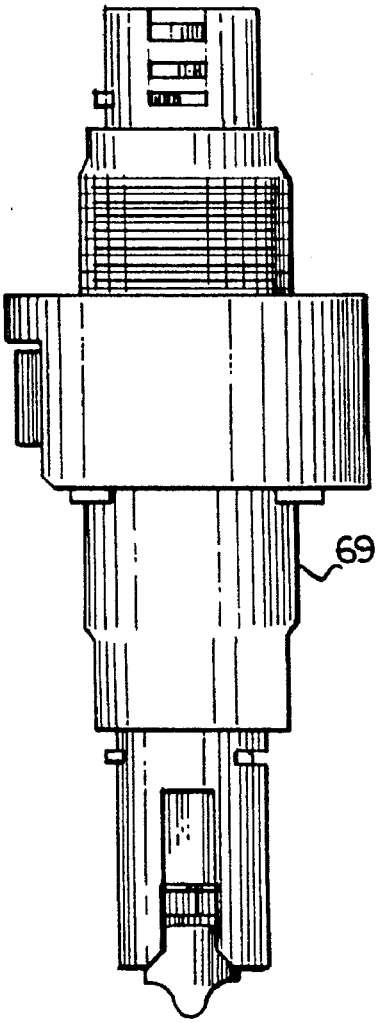
FIGS. 14*a* and 14*b* are classic ANSI Grade 1 and Grade 2 lock bodies respectively with an interchangeable core cylinder.
Figure 14B:
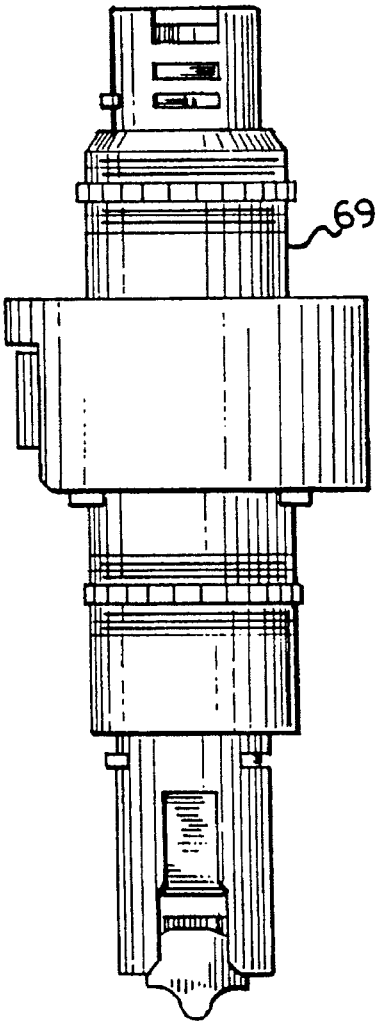
Figure 12:
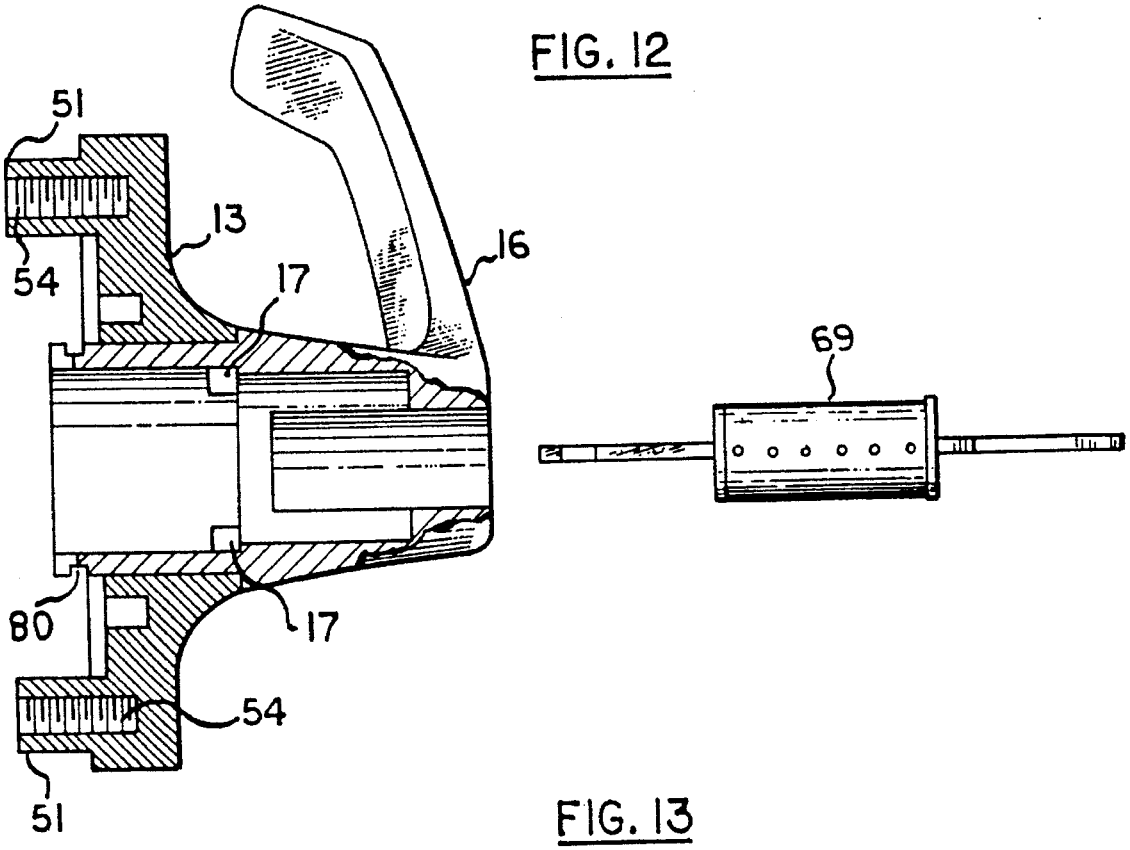
FIG. 12 is a partially fragmented, partially cross-sectional view, taken on a vertical plane through the longitudinal axis of the assembly showing a lever rose assembly and an interchangeable core cylinder positioned for insertion.
Figure 13:
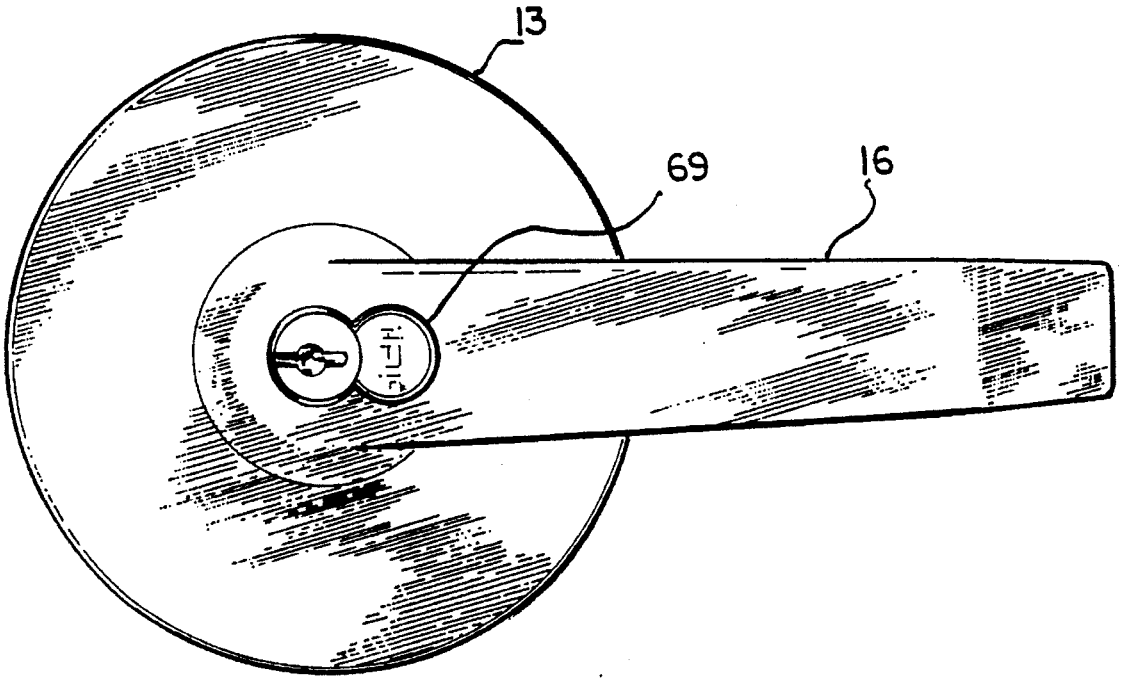
FIG. 13 is a front elevation view of a lever and rose with an interchangeable core cylinder.

FIGS. 12, 13 and 14 show the adaptation of this invention to a cylindrical lock body when using an interchangeable core cylinder 69. The cylindrical lock body, shown in exemplary alternate embodiments 14*a* and 14*b*, is the standard lock body and this invention will retrofit and operate such forms. This invention can also, with a cylindrical lock body in ANSI Grades 1 and 2 as shown in FIG. 14, form a complete interchangeable core cylindrical lockset as shown in FIG. 12 and FIG. 13. The outside lever handle 16 is provided for the interchangeable core lock. In FIG. 12, the interchangeable core lever drive 17 is shown.

This invention may also be used as a knob operating cylindrical lockset with an interchangeable cylinder core system with any shape knob, including decorative types and, also, with decorative levers.

This invention reduces or eliminates rattles, wobbles and friction when compared with other conventional unaltered cylindrical locksets.

In addition, in this invention, the key cylinder is in entombed and is no longer accessible from the outside. The only way to assess the key cylinder is to undo the through bolting from the inside of the lock. Thus, there is much more security against violent destruction of the lock than is offered by other conventional cylindrical locks. The sleeve or shaft extending from the lever handle protects the key cylinder. Other prior art locks have a thin metal extension between the handle and the remainder of the lock with a small visible hole that gives access to the spring clip that holds the key cylinder in place. A sharp blow on this section in conventional locks may break the lock apart and permit the key cylinder to be removed.

Prior art devices utilizing springs to oppose rotation lack positive stops that prevent the user from twisting or turning too far or with too much force and thus damaging the lock. On the contrary, the present invention employs a positive stop disk.

I claim:

1. A field conversion means to convert a knob-handle pure cylindrical lockset having a cylinder lock spindle coacting with a latch, initially installed in a door, to a lever-handle lockset, said means comprising a pair of lever-handles, a pair of rosettes or escutcheons, wherein each said rosette or escutcheon is provided with a pair of mounting studs, each of said studs sized and configured to receive a through bolt, a through bolt connecting said pair of rosettes or escutcheons, spring means in said rosette or escutcheon, said spring means being biased to oppose droop of said lever-handle from a normal horizontal position and to oppose downward operating force applied to said lever-handle, stop means in said rosettes or escutcheons to limit the angular rotational travel of said lever-handle, and a drive cartridge adapter cylinder wherein an inside drive cartridge adaptor is provided with an external projecting tab to engage a longitudinal slot in said initially installed lockset spindle and an internally projecting tab aligned with said external tab to operatively connect said lever-handle to said spindle, said tab and slot providing only a rotational connection-between said lever-handle and said cylinder lock spindle, said lever-handle being solely supported on and solely axially connected to said rosette or escutcheon.

2. A field conversion means as set forth in claim 1 wherein said spring means is a helical coiled spring having projecting nibs at each end thereof.

3. A field conversion means as set forth in claim 2 wherein said rosette or escutcheon has an interior surface and said stop means is at least one termination of at least one partially circumferential slot in said interior surface.

4. A field conversion means as set forth in claim 3 wherein said field conversion means includes a positive stop disk, said disk having at least one cam extending angled to the plane of said cam disk, said cam bearing against one of said nibs on said spring, the other of said nibs being positioned against a said stop disk to prevent circumferential movement thereof, the rotation of said disk moving said one of said nibs circumferentially relatively to said other of said nibs, whereby said spring is stressed and the force exerted by said spring is increased.

5. A field conversion means as set forth in claim 4 wherein said lever-handle includes an inwardly extending sleeve, said sleeve having at least one longitudinal slot, and said positive stop disk includes at least one drive tab in the plane of said disk, said drive tab configured and sized to fit into said slot in said sleeve, whereby rotation of said lever-handle rotates said disk.

6. A field conversion means as set forth in claim 5, wherein a compensating rose is included, said compensating rose having an outwardly facing recess to provide clearance to said disk and said spring means in said rosette.

7. A field conversion means as set forth in claim 6 wherein said sleeve has an external fully circumferential slot near the inner end thereof, a split ring retainer, said retainer configured and sized to fit into said circumferential slot on said sleeve to retain said spring and said positive stop disk in assembled position.

8. A field conversion means as set forth in claim 7 wherein there is an inside conversion means for the inside of said door and an outside conversion means for the outside of said door thereby pair of said conversion means are provided, whereby both sides of said door may be converted.

9. A field conversion means to convert a knob-handle lockset having a spindle coacting with a latch, initially installed in a door, to a lever-handle lockset, said means comprising a lever-handle, a rosette or escutcheon having an interior surface, a helical coiled spring having projecting nibs at each end thereof in said rosette or escutcheon, said spring being biased to oppose droop of said lever-handle from a normal horizontal position and to oppose downward operating force applied to said lever-handle, stop means comprising at least one termination of at least on partially circumferential slot in said interior surface of said rosette or escutcheon to limit the angular rotational travel of said lever handle, and a drive cartridge adapter cylinder to operatively connect said lever-handle to said spindle, a positive stop disk, said disk having at least one cam extending angled to the plane of said cam disk, said cam bearing against one of said nibs on said spring, the other of said nibs being positioned against a said stop disk to prevent circumferential movement thereof, the rotation of said disk moving said one of said nibs circumferentially relatively to said other of said nibs, whereby said spring is stressed and the force exerted by said spring is increased, said lever-handle including an inwardly extending sleeve, said sleeve having at least one longitudinal slot, and said positive stop disk including at least one drive tab in the plane of said disk, said drive tab configured and sized to fit into said slot in said sleeve, whereby rotation of said lever-handle rotates said disk, a compensating rose having an outwardly facing recess to provide clearance to said disk and said spring means in said rosette, said sleeve having an external fully circumferential slot near the inner end thereof, a split ring retainer, said retainer configured and sized to fit into said circumferential slot on said sleeve to retain said spring and said positive stop disk in assembled position, wherein there is an inside conversion means for the inside of said door and an outside conversion means for the outside of said door and a pair of said conversion means are provided, whereby both sides of said door may be converted, wherein each said rosette or escutcheon is provided with a pair of mounting studs, each of said studs sized and configured to receive a through bolt, wherein an inside drive cartridge adaptor is provided with an externally projecting tab to engage a longitudinal slot in said initially installed lockset spindle and an internally projecting tab at right angles to said external tab, wherein said field conversion means includes a plurality of said cylindrical drive adapter cylinders, each of said adapters having a different diameter, whereby said field conversion means can selectively accommodate a plurality of different cylindrical locks.

10. A field conversion means to convert a knob-handle lockset having a spindle coacting with a latch and a key cylinder with a longitudinally extending tab, initially installed in a door, to a lever-handle lockset, said means comprising a lever-handle, a rosette or escutcheon, spring means in said rosette or escutcheon, said spring means being biased to oppose droop of said lever-handle from a normal horizontal position and to oppose downward operating force applied to said lever-handle, stop means comprising a positive stop disk having a tab in said rosette or escutcheon to limit the angular rotational travel of said lever-handle, and a tabless drive cartridge adapter cylinder to operatively connect said lever-handle to said key cylinder, wherein said cylindrical drive cartridge adapter is sized and configured to fit around said key cylinder and is provided with a longitudinal slot sized and configured to receive said tab on said lock cylinder and wherein said cylindrical drive cartridge adapter is provided with a second longitudinal slot to receive said positive stop disk drive tab.

11. A field conversion means as set forth in claim 10 wherein said spring means is a helical coiled spring having projecting nibs at each end thereof.

12. A field conversion means as set forth in claim 11 wherein said rosette or escutcheon has an interior surface and said stop means includes at least one termination of at least one partially circumferential slot in said interior surface.

13. A field conversion means as set forth in claim 12 wherein said positive stop disk has at least one cam extending angled to the plane of said cam disk, said cam bearing against one of said nibs on said spring, the other of said nibs being positioned against said stop disk to prevent circumferential movement thereof, the rotation of said disk moving said one of said nibs circumferentially relatively to said other of said nibs, whereby said spring is stressed and the force exerted by said spring is increased.

14. A field conversion means as set forth in claim 13, wherein a compensating rose is included, said compensating rose having an outwardly facing recess to provide clearance to said positive stop disk and said spring means in said rosette.

15. A field conversion means as set forth in claim 14 wherein said lever-handle includes an inwardly extending sleeve, said sleeve having an external fully circumferential slot near the inner end thereof, a split ring retainer, said retainer configured and sized to fit into said circumferential slot on said sleeve to retain said spring and said positive stop disk in assembled position.

16. A field conversion means as set forth in claim 15 wherein there is an inside conversion means for the inside of said door and an outside conversion means for the outside of said door and a pair of said conversion means are provided, the said drive cartridge adapter cylinder included in said outside conversion means having an externally projecting tab and an internally projecting tab, whereby both sides of said door may be converted.

17. A field conversion means as set forth in claim 10 wherein said lockset is a non-key operated privacy lockset.

* * * * *